United States Patent [19]

van Roon

[11] 4,364,322

[45] Dec. 21, 1982

[54] LIFTABLE STEERING HOUSE OR CONTROL CABIN

[76] Inventor: Johannes van Roon, A 74, 2975 BC Ottoland, Netherlands

[21] Appl. No.: 133,396

[22] Filed: Mar. 24, 1980

[30] Foreign Application Priority Data

Mar. 23, 1979 [NL] Netherlands ..... 7902315
Apr. 12, 1979 [NL] Netherlands ..... 7902933

[51] Int. Cl.[3] ..... B63B 29/02; B63B 29/22
[52] U.S. Cl. ..... 114/71
[58] Field of Search ..... 114/71

[56] References Cited

U.S. PATENT DOCUMENTS 3,942,458 3/1976 Hankin ..... 114/71

FOREIGN PATENT DOCUMENTS 1073892 1/1960 Fed. Rep. of Germany .
1921426 11/1970 Fed. Rep. of Germany .
2146806 3/1973 Fed. Rep. of Germany .
1374486 12/1963 France .
30666 7/1965 German Democratic Rep. .
1468764 3/1977 United Kingdom .
11835 3/1958 U.S.S.R. .

*Primary Examiner*—Frank Sever
*Attorney, Agent, or Firm*—Martin Smolowitz

[57] ABSTRACT

New construction for liftable steering house or control cabin on board a sailing vessel or floating body, in which the house or cabin is carried by at least one arm. Said arm is pivotally connected to the deck or deck housing or structure of the vessel and—with its other end—to the house or cabin, enabling it to be swingingly lifted from a low position up to a maximum position, and vice versa, to give a better unobstructed view for the skipper and freedom on deck. The lifting mechanism may shift the house or cabin sideways as well, keeping it continuously parallel to itself.

6 Claims, 9 Drawing Figures fig-5
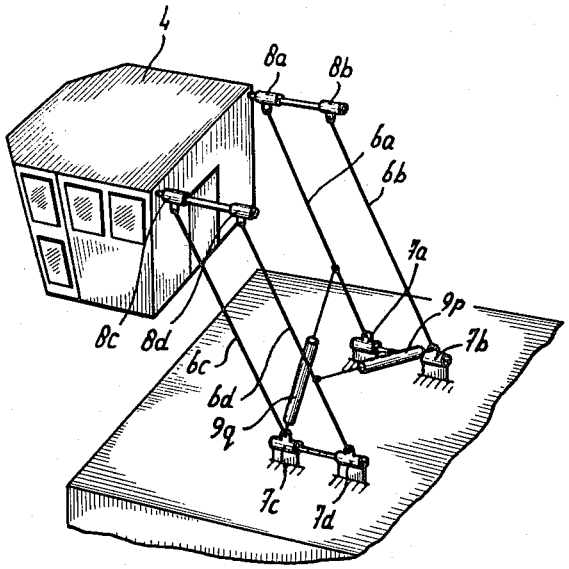
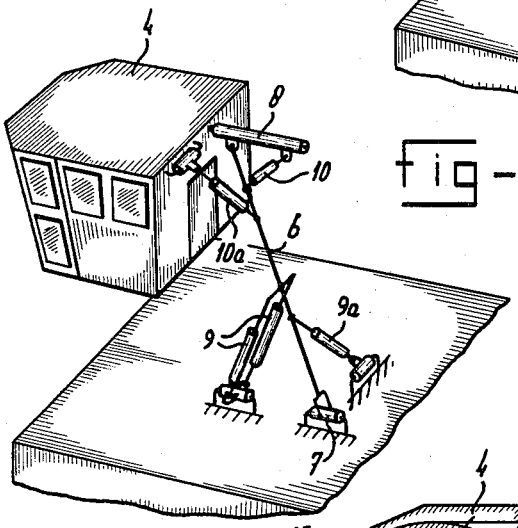
fig-6
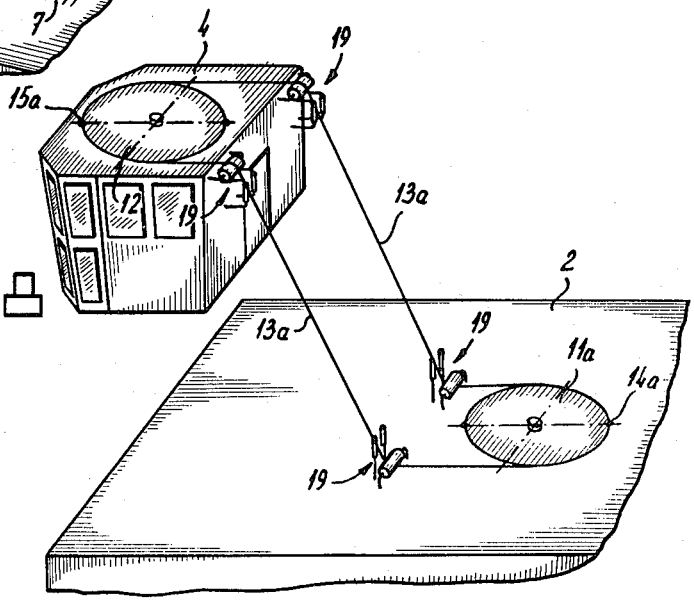
fig-8

LIFTABLE STEERING HOUSE OR CONTROL CABIN

BACKGROUND OF THE INVENTION

The invention is concerned with a liftable steering house or control cabin, more specially applicable to a sailing or floating vessel, like a pushing tug, in which the house or cabin is situated on the deck in its lowest position, whereas said house or cabin is brought into its lifted position by a lifting mechanism, which moves the house or cabin mainly at least vertically and parallel to itself during lifting or lowering, all the above in such a way, that at least both end positions are working positions of the house or cabin.

Liftable steering houses of this type are generally known, for instance used as a steering house in inland water traffic. Steering houses generally should be placed as high as possible in order to allow the skipper to have as much outlook as possible not only on the sailing water, but also on the vessel itself. However, many waterways are spanned by rigid bridges for which such a house would be in too high a position. During the trip of the vessel the steering house should be lowered when passing under such a bridge, and preferably as low as possible, in order to make as great a number of waterways as possible navigable, more specially in case the vessel is unloaded. The generally adopted construction for the lifting mchanism of said steering house consists of either a pair of scissor-shaped members or of vertically parallel guiding means. In both cases the lifting device is situated under the steering house and on the deck and in the latter case even also under the deck. In all cases the lifting device occupies deck space and requires even in the lowest position nevertheless a certain constructional height above the deck. Therefore the steering house cannot be lowered so far until it is nearly on the deck.

In case said steering house is used on pushing vessels, on which vessels the necessity of a good view is even more urgent than in the case of many conventional vessels, said steering house is always placed close after the bow and often on top of the deck house. Especially in the case of pushing vessels there are a number of disadvantages in relation to the known arrangement. The first disadvantage is concerned with the fact that especially with pushing vessels the front deck is a working deck on which the deck crew is busy regularly, for instance when coupling and uncoupling the tug to and from barges to be handled. The known lifting device occupies a major part of said deck space on the front deck. Another disadvantage is formed by the fact that the skipper cannot watch much from the steering house in its lifted position of what happens just in front of him on the fore deck, resulting in an increased risk of accidents. The invention aims to reduce these disadvantages.

SUMMARY OF THE INVENTION

The liftable steering house or control cabin according to the preamble, is characterized according to the invention in that the lifting mechanism consists of at least one carrying arm, of which the one end is articulated on the deck house of the vessel and the other end is articulated to the steering house or control cabin.

Because of this design, the front deck is absolutely free of obstacles, like the known lifting device under the steering house or control cabin, the fore deck being able to be used as a whole as a working deck and for an optimal positioning of the deck machinery, like clamps, winches etc. Also large hatchway covers can be situated on the fore deck to enable access to large pieces, like the main engines. On the other hand the steering house can be lowered almost onto the deck in the lowest working position. During the lifting movement the end of the carrying or lifting arm at the house-end will describe an arc of a circle, thanks to which the house or cabin is moved more and more in the direction of the stern when lifting is continued. The view for the skipper onto the fore deck and at the same time onto the rear of the ship becomes gradually better. With the invented mechanism it is easier to lift the house or cabin to a higher position than was possible with the known device. The better view on the rear of the ship is an advantage when for instance the anchor is dropped and in connection with the tendency to place a classical towing clamp on pushing tugs.

Especially in case of a free sailing pushing vessel or in case of an unloaded conventional ship, the trim is positively influenced thanks to the rearward displacement of the house or cabin.

Furthermore the described lifting mechanism can be built with a lower number of moving parts compared to the known devices, which simplifies servicing, increases life and strongly reduces nuisance-creating play due to wear. This is of even more importance when the vessel makes its way on salt water and through a corrosive ambient atmosphere.

Because in modern vessels with large installed power the deck house is generally placed on the main deck through vibration isolating means, the steering house or control cabin becomes free of vibrations as well if it is mounted according to the invention through its lifting arms on the deck housing. In case the deck housing is fitted directly on the deck, vibration isolating means may be incorporated in the points of articulation of the arms on the deck housing.

Under certain operating conditions of a sailing or floating unit, like a dredging vessel, it may be of advantage to move the steering house or control cabin also sideways. This is also possible with the mechanism according to the invention in a simple way. Some possible constructive solutions are known for this purpose, for instance incorporated in certain types of liftable working platforms. In those cases however the working platform rotates about a vertical axis when the platform is moved sideways in relation to its base.

Further details of the invention will be clarified in the following description of the accompanying figures describing certain designs as examples.

BRIEF DESCRIPTION OF THE DRAWINGS

FIGS. 3 and 4 illustrate in side view and top view respectively a pushing vessel according to the invention.

FIG. 5 illustrates a lifting mechanism of the type used according to FIGS. 2, 3 and 4, but adapted to shift sideways as well.

FIG. 6 illustrates a mechanism for lifting and turning sideways with one single carrying arm and a follower system.

FIG. 8 illustrates the mechanism according to FIG. 7, but adapted for turning sideways as well.

DETAILED DESCRIPTION

Figure 1:
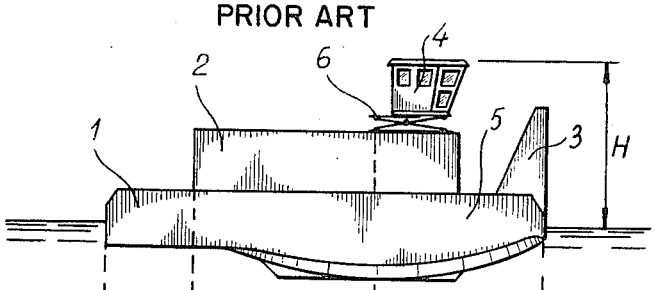
fig-1 PRIOR ART
FIG. 1 illustrates a pushing vessel in side view, fitted with a steering house according to the state of art.

In FIG. 1 a floating or sailing unit 1 is illustrated, in this case a pushing vessel. On the deck of the pushing vessel a deck housing 2 is placed. The bow 3 is adapted in a known manner for pushing duty. For said purpose the bow is appreciably upward extended. Due to this and due to the pushed lighters or barges the forward view on the deck is considerably reduced. The steering house 4 is for that purpose placed in a high position with the help of a lifting device placed on the deck housing, which lifting device makes it possible to lift the steering house, but also to lower it in case low bridges have to be passed under. On the different known lifting devices in FIG. 1 a scissor-like construction 6 is schematically illustrated. This scissor-construction is fitted under the steering house 4 in order to lift the steering house 4 vertically. In the lowest position the lifting device is folded under the steering house prohibiting the steering house from being lowered fully onto the deck. In case the liftable steering house, according to FIG. 1, is placed on the deck housing or directly on the fore deck 5, in both cases continued occupation is made an appreciable part of the fore deck. The lifting devices with vertical guides, which are also used regularly, continuously occupy much deck space as well, and often also under the fore deck 5. The deck crew, charged with coupling of the pushing vessel with a barge or lighter to form a unit or to split up a unit, will have to do many jobs on the fore deck. A fore deck 5 according to FIG. 1 proves in practice to be much too small.

Figure 2:
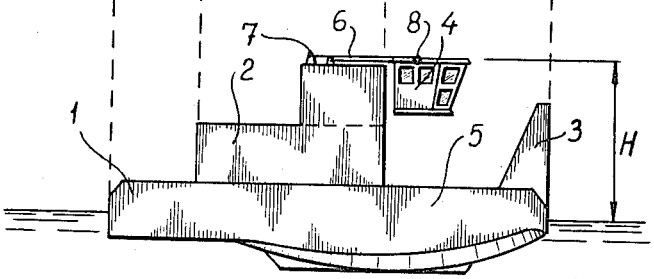
FIG. 2 illustrates the same pushing vessel as FIG. 1, but provided with a steering house according to the invention.

FIG. 2 illustrates the same pushing vessel, but equipped with a liftable steering house 4, executed according to the invention. For that purpose a pair of arms 6 are articulated to the deck housing 2 at point 7. At the other end of the lifting arms 6 is the steering house articulated at point 8. With the help of for instance hydraulic rams 9 (FIG. 3) fitted between the deck (housing) 2 and the arms 6, these arms can be pivoted upward from a lowest, approximately horizontal position about the pivoting point 7. The steering house 4 is lifted from a lowest position on the fore deck (illustrated in dotted lines), but gradually more backward as well. The view from the house on the fore deck, which was bad with the state of art constructions is improved appreciably. The rear view is improved as well. Furthermore the steering house can be lifted much higher above the deck, without bringing the stability in danger. FIGS. 1 and 2 are drawn on the same scale and placed directly one below the other. It becomes clear that, in retaining the same volume for the deck housing 2 and of the height H between the topside of the lowered steering house 4 and the water level, a much greater free frontdeck 5 results. Whenever a deck housing according to FIG. 3 is used, then the same fully free fore deck 5 becomes available, unless the steering house is placed in its lowest position. In practice this is no disadvantage because the steering house can always be lifted whenever activities will have to take place on the fore deck. According to FIG. 2 the steering house 4 is articulated at point 8 on the lifting arm 6 above its center of gravity. The steering house thus is free-handing and could make undesirable oscillating motions. For that purpose a special means, for instance as illustrated at 10 in FIG. 3 can be connected between the steering house 4 and the lifting arms 6. This means 10 can consist of a simple damper, but it may also be an hydraulic master-slave system, which follows the rotation of the arm 6 in pivoting point 7.

Figure 4:
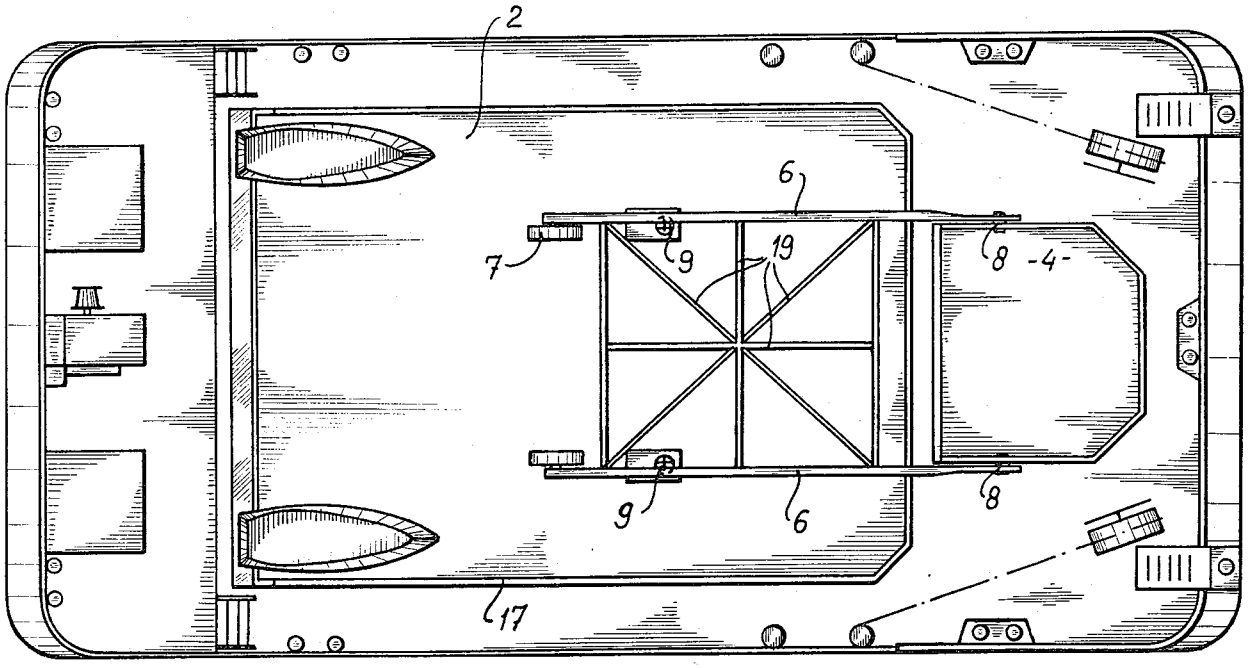

FIGS. 3 and 4 show in more detail a pushing vessel with liftable steering house according to the invention. The pivoting point 7 of the single arms 6 are placed on the deck housing 2, so that the steering house can be lowered just in front of the deck housing nearly on the fore deck 5. The lifting rams 9 are placed for that purpose in special cavities of the deck housing. According to circumstances a transverse stiffening 19 can be fitted between the arms 6. Between the main deck of the vessel's hull and the deck housing vibration isolators may be fitted, isolating the steering house in doing so as well. The communication means, necessary for the control of the ship and of the propulsion installation, can be made corresponding to the state of art, and led along the lifting arms 6 to the machinery to be controlled. For access to the steering house known means can be used (not illustrated).

FIG. 5 illustrates a corresponding design, which however is also capable of turning or swinging sideways. The house 4 is carried by two parallel parallellogram-shaped rod systems *6a, 6b* and *6c, 6d* in a double pivoting way. The pivoting center lines are all directed in two rectangular directions parallel to each other, as FIG. 5 illustrates. Apart from the normal, not illustrated, lifting rams, there are two oblique rams *9p* and *9q* fitted between the deck(housing) and the opposed lifting arms in order to control the turning motion shifting the steering house sideways.

FIG. 6 shows a combined mechanism for lifting and turning sideways with one arm and a following system like that mentioned in connection with FIG. 3. In this case however the system has to keep the steering house parallel to itself also while turning sideways, or, which is the same, parallel to the deck. Pivoting point 8 is now also adapted for turning, for which reason it is able to pivot about two perpendicular center lines. Slave-cylinder 10 looks after the lifting, just as is described with FIG. 3. For turning sideways slave-cylinder *10a* is used, which is connected between the lifting arm 6 and the steering house 4, as well as slave-cylinder 10, which however is active in a plane perpendicular to that in which the slave-cylinder 10 is working. The pivoting point 7 on the deck(housing) is again pivoting about two perpendicular center lines. The lifting rams 9 are now articulated to the deck(housing) in the same two directions, as well as the master cylinder *9a* between the arm 6 and the deck(housing), which is coupled hydraulically with the slave cylinder *10a,* in order to control the steering house during turning sideways. Also the pivoting point of the master cylinder *9a* on the deck(housing) is articulated in the same two directions.

Figure 7:
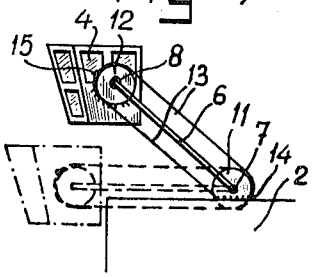
FIG. 7 illustrates an alternative lifting mechanism for the steering house.

A design according to FIG. 7 is possible as well, in which case at the pivoting point 7 and 8 of the arm 6, pulleys 11, 12 respectively are fitted to the deck and the steering house respectively. A connecting cable 13 is led over each pulley 11, 12 and connected at points 14 and 15 respectively to the pulleys, in order that the house will move parallel to itself during lifting and lowering.

FIG. 8 illustrates an addition to the suitable control means according to FIG. 7, which makes this design apt for pivoting the steering house sideways as well. The cable 13*a* is active in a plane perpendicular to that of FIG. 7. Pulley 12*a* is fitted to steering house 4, pulley 11*a* on the deck(housing). Four pairs of guiding pulleys 19, each with shafts which are placed perpendicular to each other, keep the cable 13*a* always on tension and in doing so control the steering house during turning sideways, in order to keep the house always parallel to itself during every movement.

Figure 9:
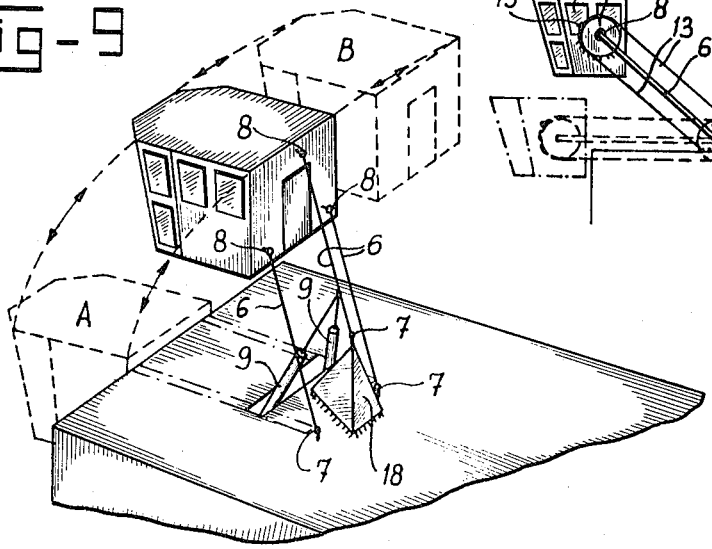
FIG. 9 illustrates another alternative lifting mechanism of the steering house, which enables turning sideways as well.
Figure 2:
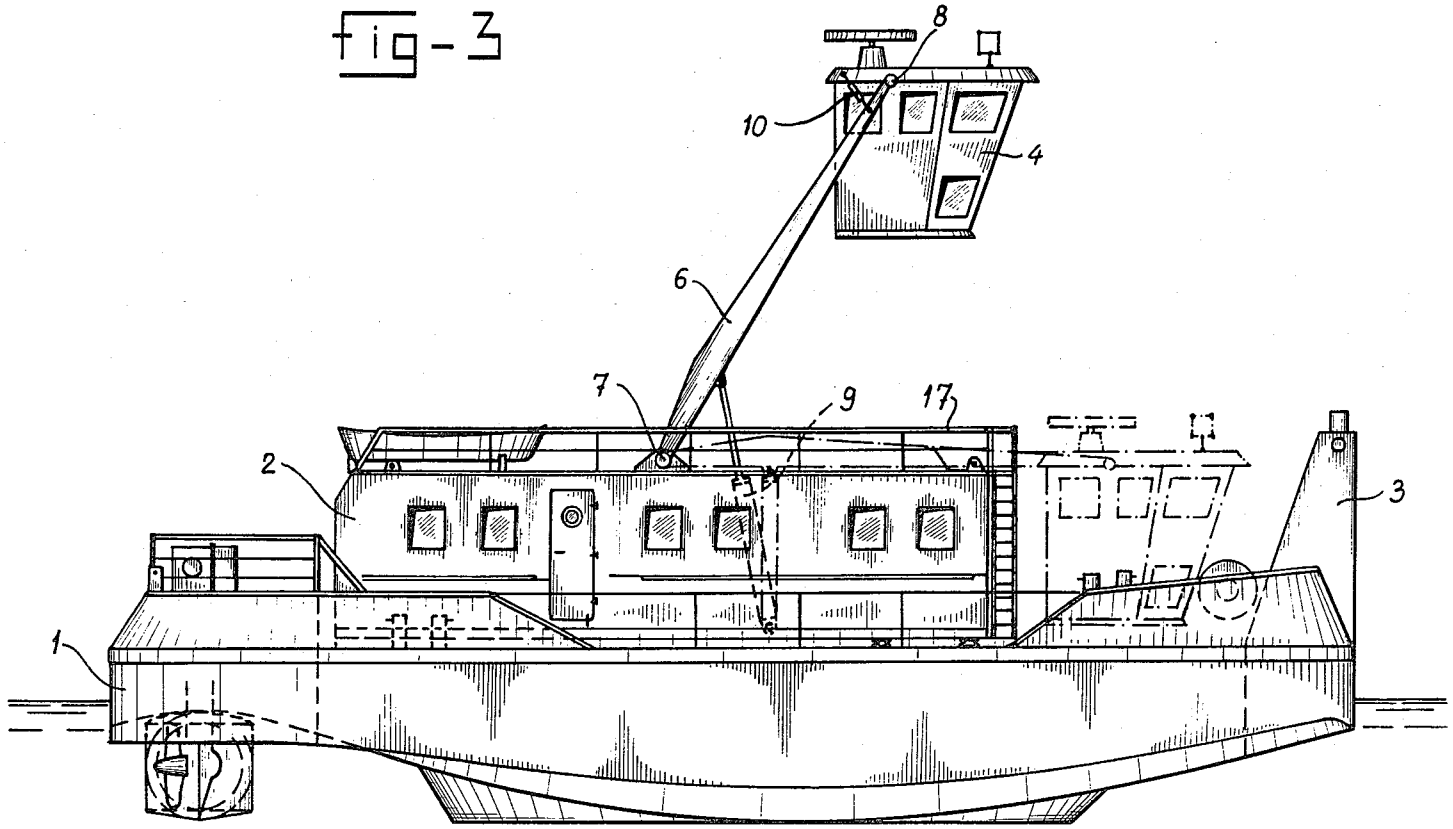

In FIG. 9 another design of the lifting mechanism is illustrated schematically, with which the steering house can be shifted to port and/or starboard. With this design the lifting and the turning mechanisms are integrated into one unit. There are three arms 6, which form a space-parallellogram. At the pivoting points 7, 8 the arms are connected with the deck or the steering house respectively, through torsionally stiff couplings, such as cardan couplings. The middle arm 6 is placed higher than the two others, the middle pivoting point 7 being fitted to a base 18 in a higher position on the deck. By means of two hydraulic rams 9, acting on the middle arm 6, the steering house can be brought into every desired position by selectively controlling the rams after each other or simultaneously.

It will be obvious that use of the steering housing according to the invention is not limited to pushing tugs only.

I claim:

1. A liftable and lowerable control cabin especially intended for a sailing or floating vessel such as a pushing tug, in which said cabin is moved off a deck of the vessel from a forward or rearward section thereof, wherein there is provided a lifting mechanism for changing position and direction of movement of said cabin during lifting and lowering and as it moves parallel to itself, said lifting mechanism being defined by only a pair of carrying arms having at least two parts, each of said arms being pivotally connected at a first end to said deck and at a second end to said cabin at above the cabin center of gravity and each arm having a hydraulic ram connected between the deck and near the lower end of said arm whereby vertical movement of the entire of said cabin from said deck occurs by the parts being pivoted in synchronism, all positions of said cabin being working positions with the cabin continuously being carried by said lifting mechanism from an uppermost position above the deck to a low position below the deck so as to provide an unobstructed space below said cabin when lifted.

2. A control cabin according to claim 1, wherein damping means are fitted between the cabin and at least one of the carrying arms to damp oscillations of the cabin.

3. An enclosure according to claim 1, wherein the means for keeping the enclosure parallel to itself under all circumstances, comprises at least one pair of hydraulically coupled master- and slave-cylinders, one of which being fitted between the carrying arm and the ship and the other between the carrying arm and the enclosure.

4. A control cabin according to claim 1, wherein the means for keeping the cabin parallel to itself under all circumstances, comprises at least one pair of hydraulically coupled master- and slave-cylinders, being fitted between the carrying arm and the cabin.

5. A control cabin according to claim 1, wherein the lifting ram is connected to said carrying arm at a point above its first end pivot point.

6. A control cabin according to claim 4, wherein the carrying arms are pivotally attached at their upper end to the upper portion of said cabin.

* * * * *